US005641062A

United States Patent [19]

Burton et al.

[11] Patent Number: 5,641,062

[45] Date of Patent: Jun. 24, 1997

[54] COMBINED GREETING CARD AND GIFT BOX APPARATUS

[76] Inventors: Karen A. Burton; Robyn S. Burton, both of 28428 GolfPoint Blvd., Farmington Hills, Mich. 48331

[21] Appl. No.: 489,387

[22] Filed: Jun. 12, 1995

[51] Int. Cl.[6] ..... B65D 69/00; B65D 85/67

[52] U.S. Cl. ..... 206/232; 206/225; 206/395; 206/409; 206/459.5

[58] Field of Search ..... 206/225, 226, 206/232, 389, 395, 409, 459.5; 229/921

[56] References Cited

U.S. PATENT DOCUMENTS

| | | | |
|---|---|---|---|
| 1,135,110 | 4/1915 | Hall | 206/409 X |
| 1,143,103 | 6/1915 | Cameron | 206/409 X |
| 1,143,729 | 6/1915 | Schmidt . | |
| 1,617,472 | 2/1927 | Wyse | 206/459.5 X |
| 2,344,437 | 3/1944 | Lande | 206/232 |
| 2,361,730 | 10/1944 | Avrick | 206/225 |
| 3,477,624 | 11/1969 | Branyon et al. | 206/409 X |
| 4,046,311 | 9/1977 | Voytko | 229/921 X |
| 4,773,532 | 9/1988 | Stephenson | 206/438 X |
| 5,038,930 | 8/1991 | Holtkamp, Jr. . | |
| 5,096,058 | 3/1992 | Juravin et al. . | |
| 5,226,532 | 7/1993 | Davidson et al. . | |
| 5,232,087 | 8/1993 | Schluger . | |
| 5,289,917 | 3/1994 | Chabria . | |
| 5,497,876 | 3/1996 | Fleming | 206/232 |

FOREIGN PATENT DOCUMENTS

| | | | |
|---|---|---|---|
| 458544 | 8/1913 | France | 206/395 |
| 82419 | 10/1919 | Switzerland | 206/409 |
| 368741 | 3/1932 | United Kingdom | 206/409 |

*Primary Examiner*—Bryon P. Gehman

*Attorney, Agent, or Firm*—Harness Dickey & Pierce P.L.C.

[57] ABSTRACT

A combined greeting card and gift box apparatus having a box portion and a moveable panel member. The moveable panel member may be moved from a closed position wherein indicia thereon in the form of a greeting or wish is not readable, to an open position wherein the indicia may be read by the recipient. When in the open position, the recipient may begin withdrawing bills of currency, gift certificates, checks or other like objects which are secured to a carrier medium and supported within the interior of the box in a coiled fashion on the carrier medium. Since the recipient has no knowledge of how many bills of currency or other like items are within the box portion of the apparatus, the enjoyment and anticipation associated with learning of the total amount of the gift is enhanced. The apparatus is further constructed from a single panel of paper-like material and may be easily and quickly constructed without any special tools, external glues, etc.

1 Claim, 2 Drawing Sheets

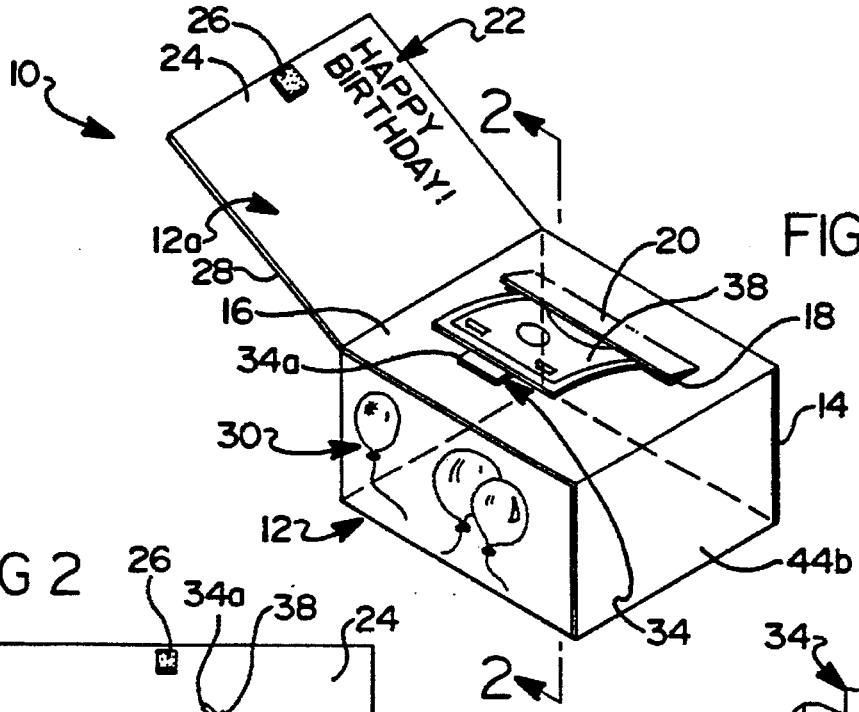
FIG 1
FIG 2
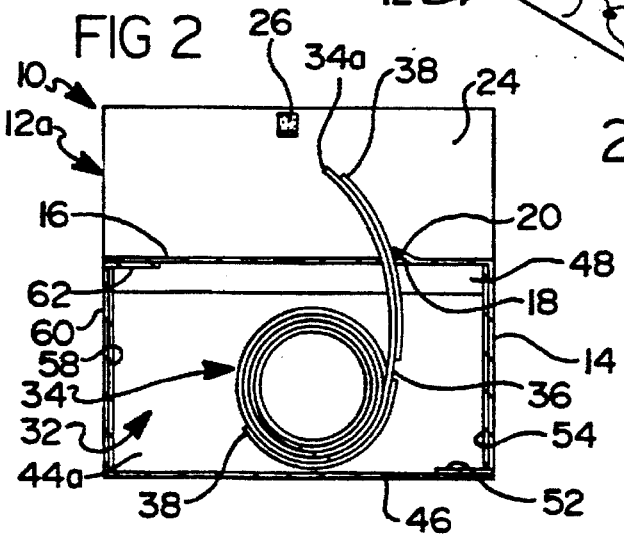
FIG 3
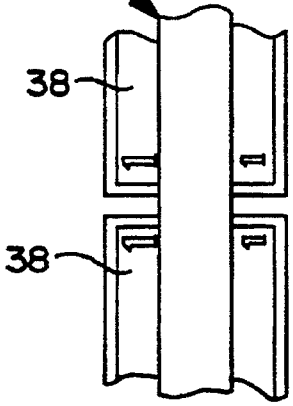
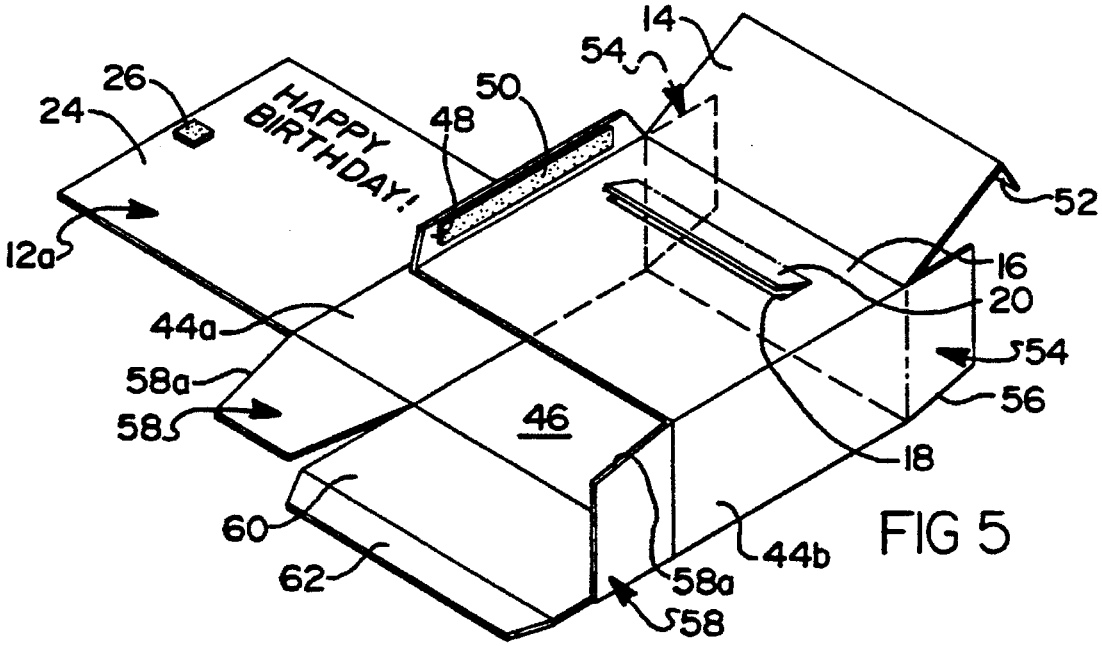
FIG 5

COMBINED GREETING CARD AND GIFT BOX APPARATUS

BACKGROUND OF THE INVENTION

1. Technical Field

This invention relates to greeting cards and gift boxes, and more particularly to a combined greeting card and gift box apparatus which is adapted to contain bills of currency therein and permit easy removal of same from the interior area of the box.

2. Discussion

Greeting cards are used in a wide-variety of situations where it is desirable to express a greeting to another person such as on a birthday, at Christmas time, or at graduation, etc. Frequently, one or more bills of currency or a check is placed in the greeting card such that when the card is opened by the recipient, the full amount of the gift associated with the giving of the card becomes immediately apparent to the recipient.

While the above form of greeting card provides a simple means by which to provide a monetary gift to another person, it would nevertheless be desirable to provide some form of apparatus which performs the function of a greeting card, but yet which does not make the full amount of the gift immediately apparent to the recipient as soon as the recipient opens the card. Such an apparatus would thus heighten the anticipation of the recipient if the recipient is not able to ascertain the full amount of the gift immediately upon opening the greeting card, but only after performing one or more additional steps once the card is opened.

Accordingly, it is a principal object of the present invention to provide a combined greeting card and gift box apparatus which is adapted to perform the function of a conventional greeting card, as well as to contain one or more bills of currency therein in a manner which allows the bills of currency to be withdrawn, one at a time, from the interior of the gift box, thus preventing the recipient from ascertaining immediately what the total amount of the gift is.

It is another object of the present invention to provide a combined greeting card and gift box apparatus which is easy and inexpensive to construct, and which performs the function of a greeting card through the use of a single moveable panel which may be moved between a closed and an open position to reveal the greeting or wish. It is a further object of the present invention to form the greeting card as an integral portion of a gift box.

It is still another object of the present invention to provide a combined greeting card and gift box apparatus having a carrier medium disposed within an interior area of the gift box to which a plurality of bills of currency may be releasably adhered, and where the gift box has a slot-like opening which allows the bills of currency to be gradually withdrawn from the gift box one-by-one.

SUMMARY OF THE INVENTION

The above and other objects are provided by a combined greeting card and gift box apparatus in accordance with preferred embodiments of the present invention. The apparatus includes a gift box having an access panel for enabling access to an interior area of the box. An opening is formed in the box in addition to a moveable panel member. The moveable panel member preferably has indicia on an inside surface defining a greeting or wish in a manner similar to a conventional greeting card. The moveable panel member may be moved from a closed position wherein the greeting or wish is not visible into an open position wherein the greeting or wish is readable.

In the preferred embodiments, the opening of the box is preferably at least slightly wider than a bill of currency. The opening enables the recipient to begin withdrawing bills of currency from the interior area of the box. Preferably, the bills of currency are adhered to the carrier medium such that a small degree of the carrier medium projects through the opening to provide a "leader" which may be easily grasped by the recipient to enable the recipient to easily begin withdrawing the bills of currency contained within the box.

It is a principal object of the present invention that the number of bills of currency, as well as the denomination of each, is not readily apparent to the recipient. The anticipation of the recipient is heightened as the recipient begins withdrawing the bills of currency from the interior of the box. In this manner, the combined greeting card and gift box apparatus provides a means for conveying a gift of money in a manner in which the total amount of the gift is not readily apparent to the recipient, such as is the case with a conventional greeting card in which the total amount of the gift becomes quickly apparent upon opening the card. The apparatus of the present invention thus provides a more enjoyable and entertaining means of presenting a gift to another person on a special occasion.

In the preferred embodiments of the present invention, the carrier medium has a thin cross-section and is coilable so as to permit a number of bills of currency to be secured thereto along the length of the carrier medium and coiled within the interior of the box. This form of carrier medium allows the bills of currency to be easily and smoothly removed through the opening in the box. In a preferred embodiment, the moveable panel member also includes an adhesive portion on an inner surface thereof which allows it to be maintained in a closed position in which the greeting printed thereon is not readable. In a preferred embodiment, the moveable panel member is formed from a portion of the material which is used to form the box in such a manner that when the moveable panel member is in its closed position, the opening of the box is also covered.

The preferred embodiments of the present invention thus form an attractive, convenient to use apparatus for performing the dual function of a greeting card and a gift box. The gift box enables a gift of currency to be provided to a recipient in a manner in which the recipient is prevented from immediately ascertaining the full amount of the gift. In this manner, the sense of anticipation of the recipient is heightened since the recipient only learns of the full amount of the gift as the carrier medium within the gift box is gradually withdrawn from the interior of the gift box.

BRIEF DESCRIPTION OF THE DRAWINGS

The various advantages of the present invention will become apparent to one skilled in the art by reading the following specification and subjoined claims and by referencing the following drawings in which:

FIG. 1 is a perspective view of a combined greeting card and gift box apparatus in accordance with a preferred embodiment of the present invention;

FIG. 2 is a cross-sectional view of the apparatus of FIG. 1 in accordance with section line 2—2 in FIG. 1, showing the carrier medium coiled into a roll within the gift box with a plurality of bills of currency attached thereto;

FIG. 3 is a plan view of a portion of the length of the carrier medium showing portions of a plurality of bills of currency releasably adhered thereto;

FIG. 5 is a perspective view of the apparatus of FIG. 1 in a partially assembled configuration.

DETAILED DESCRIPTION OF THE PREFERRED EMBODIMENTS

Figure 4:
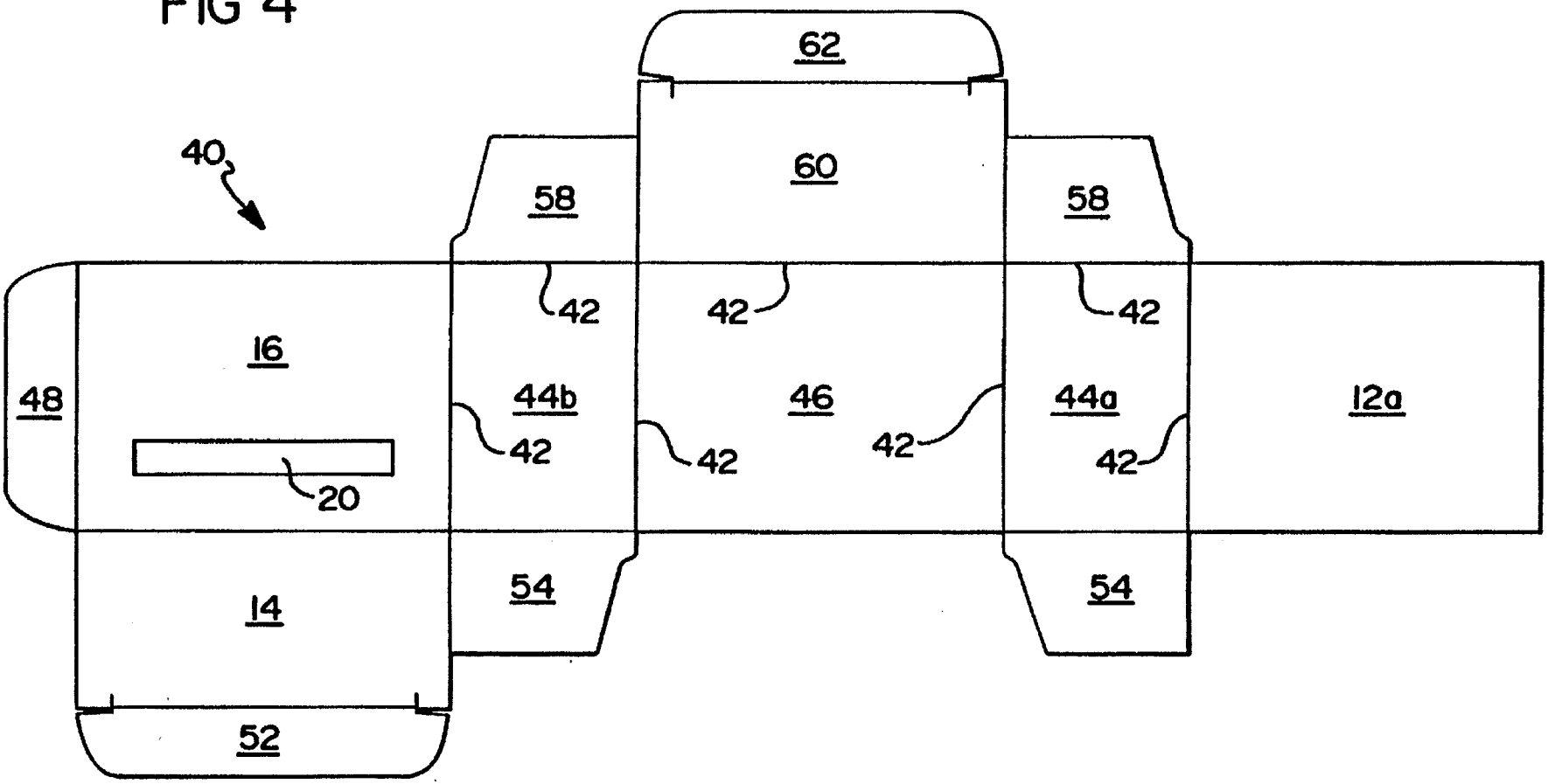
FIG. 4 is a plane view of the panel of paper-like material used to construct the apparatus of the present invention, and showing the fold lines thereon.

Referring to FIG. 1, there is shown a combined greeting card and gift box apparatus 10 in accordance with a preferred embodiment of the present invention. The apparatus 10 generally comprises a box 12 having a moveable panel member 12*a*. The box 12 includes an access panel 14 which may be quickly and easily opened to enable access to the interior area of the box 12, and a top panel 16 having an elongated, slot-like opening 18 formed therein by cutting a flap 20 in the top panel 16. The total width of the elongated slot 18 is preferably at least slightly greater than the width of a United States bill of currency.

With further reference to FIG. 1, the moveable panel member 12*a* preferably includes some indicia 22 printed on an interior surface 24 thereof. The interior surface 24 further preferably includes some form of an adhesive 26 which enables the panel member 12*a* to be held in a closed position against the top panel 16, thereby covering the opening 18 when the apparatus 10 is first presented to another person as a gift. An exterior surface 28 of the panel member may also include some indicia thereon relating to the occasion for presenting the gift (i.e., a birthday, graduation, etc.). Similarly, other indicia 30 may be printed on one or more panels of the box 12 to provide a decorative appearance to the exterior of the box 12 suitable to the occasion for which the apparatus 10 is being presented.

With reference to FIG. 2, within an interior area 32 of the apparatus 10 is placed a length of carrier medium 34. The carrier medium 34 may be comprised of a length of paper-like material having a conventional adhesive on one surface 36 thereof. Preferably, the adhesive is of a conventional type which allows an object such as a bill of currency to be releasably secured to the carrier medium 34 such that the bill of currency can be quickly and easily removed from the carrier medium 34 without transferring any appreciable amount of the adhesive to the currency. Thus, it will be appreciated that the adhesive functions to allow bills of currency to be quickly and easily attached to the carrier medium 34 without the risk of the currency becoming permanently attached to the carrier medium 34.

With reference to FIG. 3, a portion of the carrier medium 34 is illustrated. The overall width of the carrier medium 34 is preferably at least slightly less than the overall width of a United States bill of currency. In the illustration of FIG. 3, portions of a pair of bills of currency 38 are depicted being releasably secured to the carrier medium 34 closely adjacent one another. The ability of the carrier medium 34 to be coiled into a relatively small diameter coil allows a numerous plurality of bills of currency 38 to be rolled into a relatively tightly wound coil within the interior area 32 of the box 12, while still enabling the bills of currency 38 to be easily withdrawn through the opening 18 by the recipient of the apparatus 10.

With brief reference to FIG. 4, the entire apparatus 10 is formed from a single sheet of paper or thin cardboard 40, shown in its completely unfolded condition, with the lines 42 indicating lines at which a fold is made to form the apparatus 10. The box 12 of the apparatus 10 is constructed by folding panel portions 44 perpendicularly to a bottom panel 46, and subsequently folding over the top panel 16 such that it lies parallel to the bottom panel 46.

With brief reference to FIG. 5, the top panel 16 includes a flap 48 having a strip of adhesive material 50 placed thereon. The adhesive material 50 is not a readily releasable form of adhesive, but rather one that more permanently adheres to a portion of the panel 44*a* when the panel 44*a* is folded upwardly parallel to the panel 44*b* to thereby hold the flap 48 and panel 44*a* securely together in a non-releasable fashion.

With further reference to FIG. 4, the access panel 14 is urged downwardly during assembly after side flaps 54 are tucked in perpendicular to the panel portions 44*a* and 44*b* such that a lower flap portion 52 may be inserted underneath lower edges 56 of each of the side flaps 54 and on top of the bottom wall 46. A second pair of side flaps 58 are folded inwardly relative to each other such that they lie perpendicular to the side panels 44*a* and 44*b* and in a common plane before an end panel 60 is folded upwardly towards the top panel 16. A flap 62 on the end panel 60 may then be inserted over top edges 58*a* of each of the side flaps 58 such that it extends inwardly into the interior area of the box 12 underneath the top panel 16. The construction of the access panel 14 and the side flaps 54 enable the carrier medium 34 to be quickly and easily removed so that one or more bills of currency 38 can be secured thereto.

It will be appreciated, however, that the construction of the box and the manner in which the various panels thereof are formed and assembled together may very widely and yet accomplish the same essential purpose of providing a mostly hidden carrier medium within the interior of the box which may be gradually withdrawn through an opening on some panel of the box.

In use, an individual signs his or her name on the interior surface 24 of the moveable panel member 12*a* and then folds the panel member 12*a* downwardly against the top panel 16 such that the moveable panel member 12*a* remains in its closed position because of the adhesive 26. The access panel 14 may then be opened and the carrier medium 34 withdrawn therefrom. One or more bills of currency, or alternatively, one or more checks, gift certificates, etc., are adhered to the adhesive surface side 36 of the carrier medium 34 closely adjacent one another. Preferably, at least the first bill of currency 38 is secured to the carrier medium 34 such that a small portion of the carrier medium 34 extends beyond the edge of the bill of currency 38, as shown in FIG. 1, to thereby provide a "tab" or "leader" 34*a* which may be grasped easily by the fingers of an individual. Once all of the bills of currency 38 are secured to the carrier medium 34, the assembly is coiled up into the form shown in FIG. 2 such that only the leader 34*a* of the carrier medium 34 projects through the opening 18 in the top panel 16. This step may also be accomplished while the moveable panel member 12*a* is in its open position. Once the coiled carrier medium 34 is positioned within the interior area 32 of the box 12, the access panel 14 is closed and the lower flap portion 52 (FIG. 5) is inserted underneath the lower edges 56 of the side flaps 54, to thus close the box 12.

When the apparatus 10 is presented to the recipient, the recipient first opens the moveable panel member 12*a* and reads the indicia 22 printed on the interior surface 24 thereof. The recipient may then grasp the leader of the carrier medium 34 and begin withdrawing the bills of currency 38. Since the recipient has no knowledge of how many bills of currency 38 are contained within the box 12, the sense of anticipation and enjoyment of receiving the gift are enhanced as the bills of currency 38 are gradually withdrawn one-by-one from the box 12.

The apparatus 10 of the present invention thus forms a unique means by which a conventional birthday card and gift box may be combined in an inexpensive and easily constructed apparatus to provide an added degree of enjoyment when giving gifts of currency. The apparatus 10 further requires no special tools or extensive assembly and disassembly steps to implement, is inexpensive to construct, and is suitable for a wide-variety of occasions or events where a greeting card or a gift of money, gift certificates, etc., would be appropriate.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A combined greeting card and gift box apparatus comprising:

a box including an adhesive strip for holding two panels thereof together:

an access panel moveable between an open position and a closed position for enabling access to an interior area of said box;

a carrier medium having an adhesive on one surface thereof for releasably securing a gift thereto and being coiled into a roll sufficiently small to fit within said interior area of said box;

an elongated, slot-shaped opening formed on at least one surface of said box in communication with said interior area of said box and being of dimensions sufficiently large to permit said carrier medium and a gift secured to said carrier medium to be passed therethrough;

a panel member moveable between a closed position wherein said opening is covered by said panel member and an open position wherein said opening is accessible;

an adhesive on one surface of said panel member for temporarily holding said panel member in said closed position;

wherein said moveable panel member includes indicia providing a greeting on an interior surface thereof not visible when said panel member is in said closed position; and wherein said box is formed from a single piece of paper-based material.

* * * * *